United States Patent [19]

Chen et al.

[11] 4,285,125

[45] Aug. 25, 1981

[54] BARBER-TYPE RAZOR

[75] Inventors: Evan N. Chen, Fairfield; Lawrence Crainich, Stratford; Frank A. Ferraro, Trumbull, all of Conn.

[73] Assignee: Warner-Lambert Company, Morris Plains, N.J.

[21] Appl. No.: 39,084

[22] Filed: May 14, 1979

[51] Int. Cl.[3] ..... B26B 21/10

[52] U.S. Cl. ..... 30/53

[58] Field of Search ..... 30/30, 53, 54, 55, 330, 30/336, 338

[56] References Cited

U.S. PATENT DOCUMENTS

| | | | |
|---|---|---|---|
| 1,817,262 | 8/1931 | McGirr | 30/330 X |
| 2,539,574 | 1/1951 | Fulmer | 30/53 X |
| 2,601,523 | 6/1952 | Hill | 30/330 |
| 3,728,788 | 4/1973 | Pearson | 30/53 |
| 3,772,778 | 11/1973 | Ishida | 30/53 |

FOREIGN PATENT DOCUMENTS

| | | | |
|---|---|---|---|
| 52-12064 | 1/1977 | Japan | 30/53 |
| 52-34858 | 3/1977 | Japan | 30/53 |

*Primary Examiner*—Gary L. Smith

*Attorney, Agent, or Firm*—S. A. Schneeberger; R. S. Strickler

[57] ABSTRACT

A barber or straight edge razor houses a replaceable blade and includes a body member having a handle and a blade-receiving base portion, a clamp member detachably hinged to the base portion to comprise opposite halves of the razor, and bias apparatus between the razor halves above the hinge for urging the lower portions of the razor halves relatively toward each other to retain the blade therebetween. The blade is releasable by moving the upper portions of the razor halves relatively toward one another. Along a rear gripping portion of the razor halves, one of the halves is structured to assume substantially all of the normal gripping forces so as to prevent inadvertent release of the blade, while the halves include a forward region which is structured to receive special pinching forces to release the blade. Upwardly and rearwardly inclined ridges in the blade-retaining region may be provided to aid in upward seating of the blade as it is moved rearwardly into the razor. Also, the hinge pivot pins may be integral with one of the razor halves and hinge tubes are integral with the other.

18 Claims, 8 Drawing Figures

BARBER-TYPE RAZOR

BACKGROUND OF THE INVENTION

This invention relates to a barber razor and more particularly to an improved barber razor for housing a replaceable blade.

Barber razors for housing replaceable blades have been disclosed in the prior art. One such barber razor includes a base portion, a clamp member for hinged connection with the base portion, a separate removable hinge pin or pivot pin, and a leaf spring between the base portion and clamp member positioned above the longitudinal hinge for urging the lower portions of the base portion and clamp member relatively toward one another to retain a replaceable blade therebetween. A "pinching" or "squeezing" force applied to the top of the razor releases the blade.

In another such barber razor, the base portion and the clamp member are joined by a longitudinal hinge including a separate removable hinge pin or pivot pin. A leaf spring is positioned between the base portion and clamp member below the hinge for biasing the lower portions thereof relatively apart in a blade-releasing orientation. A slide cam at the top of the razor may be actuated to a position in which it overcomes the spring bias and urges the razor's lower portions relatively toward one another to retain a replaceable blade therebetween.

Each of the foregoing barber razors provides for insertion thereinto of a projection on a blade-storing magazine from which a replaceable blade is then directly inserted. Further, each such razor includes provision for separating the clamp member from the base portion by removing the pivot pin to facilitate cleaning.

In still another barber razor, a blade is directly placed on a base portion, with locating holes in the blade fitting over retaining bosses on the base portion, and the dovetail connector of a clamp member is longitudinally slid into a complementary dovetail connector on the base portion to closely position the clamp over the blade. A spring above the dovetail connector urges the lower portions of the base portion and clamp member toward one another to firmly embrace the blade. The spring acts as a yieldable detent to restrict removal of the clamp member, which removal is necessary to remove the blade.

It is the principal object of the present invention to provide a barber razor of the blade-replaceable type which further provides for increased ease and/or sureness of handling.

SUMMARY OF THE INVENTION

In accordance with the present invention, there is provided a barber-type razor for housing a replaceable blade and being of the general type which includes a body member having a handle and a blade-receiving base portion, a clamp member hinged to the base portion by means of a hinge between and extending longitudinally of the base portion and the clamp member, the base portion and clamp member substantially comprising opposite halves of the razor, the hinge being located between the top and bottom portions of the razor halves, and bias means provided for urging the bottom portions of the razor halves relatively toward one another for retaining a blade therebetween, the blade being released when the top portions of the razor halves are moved relatively toward one another. The razor has a first region along the top portion thereof for receiving manual gripping forces during normal use and a second region forward of the first region for receiving manual blade-releasing squeeze forces. In accordance with the invention, one of the razor halves extends upwardly beyond the other along the first gripping region to receive any such gripping forces substantially exclusively of the other to prevent inadvertent release of a blade, the razor halves being upwardly substantially co-extensive along the second region to facilitate application of a manual blade-releasing pinch force to both halves in the second region. Preferably the base portion extends above and transversely over the clamp member in the razor first region, which region is substantially longer than that of the second region.

According to another aspect of the invention, the hinge connecting the razor halves is provided by a pair of hinge tube means affixed to one of the halves and a pair of pivot pins affixed to the other. The pivot pins are preferably press-fitted into respective support tubes which are in turn affixed to the respective razor half. A leaf spring seated in one half of the razor and longitudinally restrained by complementary bends in the seat and spring includes a knee intermediate its ends, which knee extends into and is longitudinally retained by a recess formed in the other half of the razor thereby to inhibit relative longitudinal motion of the razor halves.

According to a still further aspect of the invention, a blade-seating region exists below the hinge for receiving a blade introduced thereinto from the front of the razor, which seating region includes an array of longitudinally spaced upwardly extending rearwardly inclined ridges on the inner surface of at least one of the razor halves.

DESCRIPTION OF THE PREFERRED EMBODIMENTS

Figure 1:
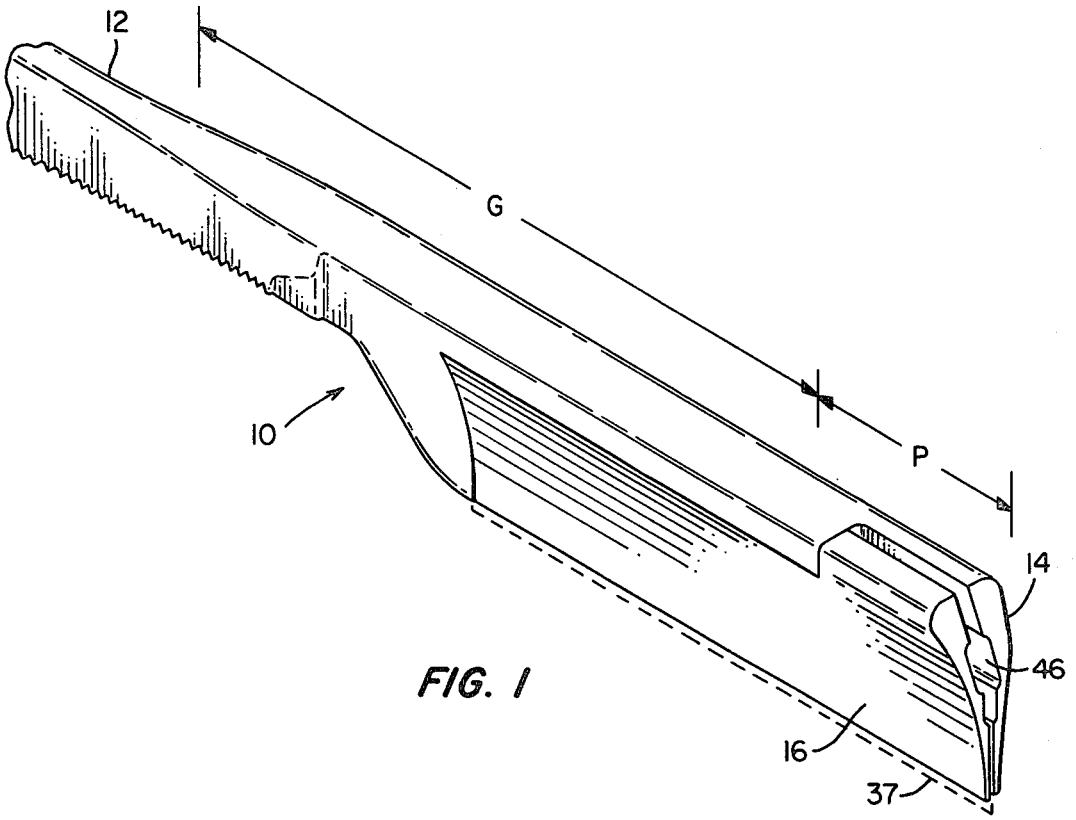
FIG. 1 is a perspective view of the main portion of the assembled razor.
Figure 2:
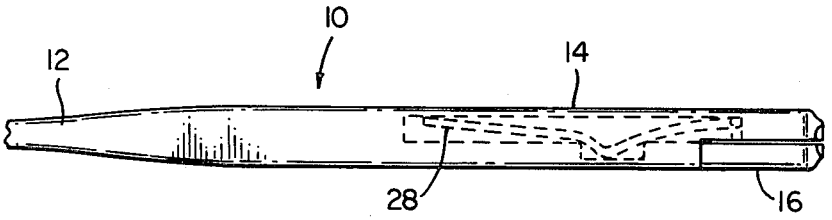
FIG. 2 is a top view of the razor of FIG. 1.
Figure 3:
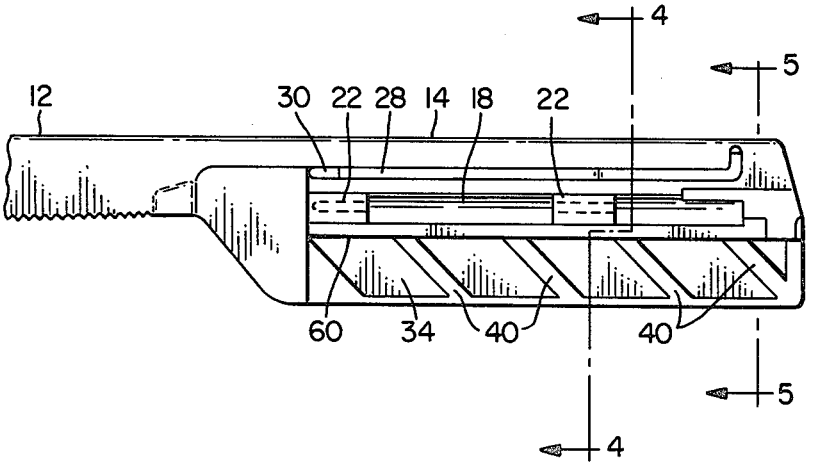
FIG. 3 is a side view of the body member of the razor of the invention showing the inner surface of the base portion thereof.
Figure 4:
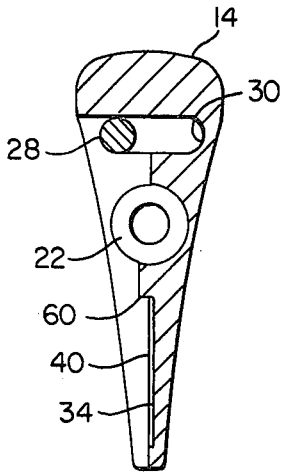
FIG. 4 is a sectional end view of the body member taken along line 4—4 of FIG. 3.
Figure 5:
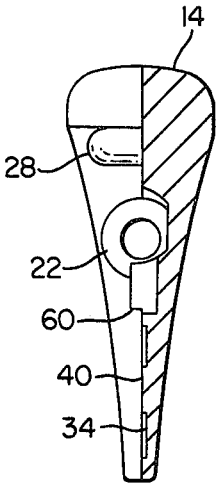
FIG. 5 is a sectional end view of the body member taken along line 5—5 of FIG. 3.
Figure 7:
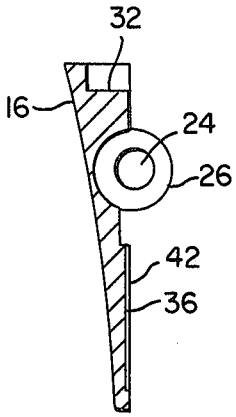
FIG. 7 is a sectional end view of the clamp member taken along line 7—7 of FIG. 6.
Figure 6:
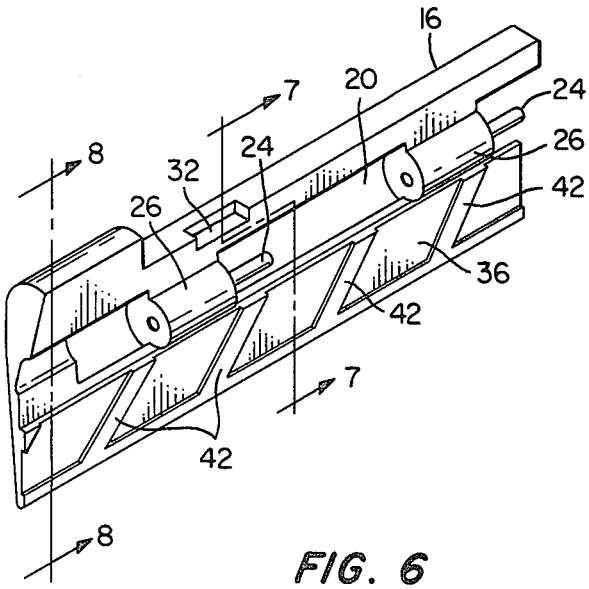
FIG. 6 is a perspective view of the inner surface of the clamp member of the razor of the invention.
Figure 8:
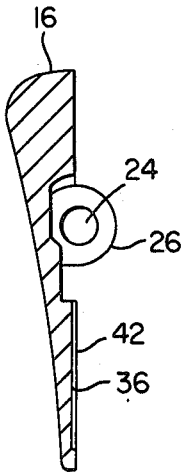
FIG. 8 is a sectional end view of the clamp member taken along line 8—8 of FIG. 6.

Referring to the drawings, a barber-type razor 10 in accordance with the invention comprises a body member consisting of a handle 12 and a blade-receiving base portion 14, and a clamp member 16. The body member of the razor may be pivotally connected to a sheath (not shown) which serves alternately as an extension to the handle 12 and also to house the razor when not in use. The clamp member 16 and the base portion 14 are generally similar in shape and thus will sometimes be referred to, for convenience, as opposite halves of the razor.

The base portion 14 and the clamp member 16 include semi-cylindrical slots 18 and 20 respectively longitudinally formed in the mid-region between the top and bottom extremes of the razor. Both slots 18 and 20 extend most or all the length of the base portion 14 and clamp member 16. A pair of longitudinally spaced hinge tubes 22 are rigidly affixed to base portion 14 in slot 18. A pair of longitudinally spaced pivot pins 24 are fixedly supported in a respective pair of pin support tubes 26 which are in turn rigidly affixed to clamp member 16 in slot 20 thereof. A leaf spring 28 is retained in a spring seat 30 comprised of a longitudinally extending elongated slot in the base portion 14 above the hinge tubes 22. A notch or recess 32 of abbreviated length in the inner surface of clamp member 16 engages part of spring 28 to inhibit relative longitudinal motion between razor halves 14 and 16. The lower portion of the razor halves below hinge tubes 22 and hinge pins 24 comprises blade-seating regions 34 and 36 in razor halves 14 and 16 respectively for embracing a blade 37 therebetween. A raised longitudinal rib 60 extends along the top of the seating region 34 to define the upper limit to the blade seat.

Referring to the razor 10 in greater detail, with particular reference to FIG. 1, it will be appreciated that the person holding the razor may normally apply a gripping or grasping force along the upper portion of the razor anywhere over a region G comprising most of its length with the exception of a forwardmost region P thereof. Along that region of base portion 14 which is co-existent with gripping region G, the base portion has been extended above and transversely over the clamp member 16 such that substantially only the base portion 14 and not clamp member 16 receives the gripping forces occasionally present during normal use. Typically the vertical extent or thickness of the part of the base portion 14 which extends over the clamp member 16 is about 0.15 inch and its transverse extent places it at least flush with the outer surface of clamp member 16. More specifically, the base portion 14 and clamp member 16 are vertically substantially co-extensive along the forward "pinch" region P of the razor, which region may be about one-half inch in length, and the upper portion of the clamp member is set downwardly or effectively removed in the region G to the rear of region P to allow the transversely extending upper part of base portion 14 to extend thereover.

It will be appreciated that the spring 28 positioned above the hinge tubes 22 and pins 24 normally acts to bias the lower portions of the razor halves into blade-embracing relationship and the blade 37 may be released from razor 10 substantially only by the application of a pinching force to the upper extremes of the razor halves in the forwardmost region P, thus avoiding the unintentional release of the blade by the application of normal gripping forces in the region G. The portions of the razor halves which co-extend in the region G are between two and three times as long as the region P.

According to another aspect of the invention, the hinge pins 24 are substantially integral with clamp member 16 by means of their press-fitted insertion into their respective pin support tubes 26. Such arrangement avoids the need for separate removal of the pivot pins when the razor is to be disassembled and thus avoids requirement of a pin removal tool and/or the loss of the pivot pins while disassembled. It will be noticed that the pin support tubes 26 are forwardly offset from the respective hinge tubes 22 and the pivot pins 24 extend rearwardly from support tubes 26 for alignment with and rearward insertion into the respective hinge tubes 22 during assembly of the razor halves.

The spring seat 30 includes a sharp upward bend at its forward extreme for receiving a corresponding sharp upward bend in the leaf spring 28 and thereby effectively securing the forward end of the leaf spring against longitudinal motion relative to the base portion 14. This arrangement avoids the need for a separate pin to retain the spring and, by closely sizing the seat 30 to the spring 28, the spring can usually be retained in the seat when the razor is disassembled. The leaf spring additionally includes a pronounced deformation or knee directed outwardly from the spring seat 30 near its mid-point. This knee not only acts to contact the clamp member above the pivot pins 24 and thereby urge the lower portions of the razor halves into blade-retaining engagement, but it also is received and yieldably retained in the notch 32 in clamp 16 to serve as a detent for yieldably preventing or substantially restricting relative longitudinal movement between the razor halves when assembled. The rearward end of spring 28 is free to move longitudinally in seat 30 to accommodate the compression caused by the clamp member 16.

According to another aspect of the invention, the blade-seating regions 34 and 36 of the respective razor halves include respective arrays of raised ridges 40 and 42 thereon. The raised ridges 40, 42 define a substantial portion of the blade-supporting surface of each of the razor halves and, importantly, are arrayed in a longitudinally spaced, upwardly extending, rearwardly inclined orientation. The ridges 40, 42 engage and support blade 37 not only when it is fully seated in the razor but also while it is being introduced to the razor. It is this latter engagement of the blade by the upwardly and rearwardly inclined ridges 40, 42 while the blade 37 is being longitudinally rearwardly introduced to the razor that serves to aid in directing the blade to its uppermost seated position against rib 60 in the razor. Ridges 40, 42 are raised about 0.005 inch from their bases. Rib 60 extends beyond ridges 40 so as to create a limit for the blade. A hole 46 defined by enlarged recesses in clamp member 16 and base portion 14 near the front ends thereof provides for insertion of a key-type projection associated with a blade supply magazine (not shown) when a new blade is to be provided to the razor from the supply magazine. When the projection of the blade supply magazine is introduced to the hole 46, it serves to relatively separate the blade-retaining portions 34, 36 of the razor halves such that a new blade may then be longitudinally rearwardly introduced to the razor and is subjected to the upwardly directed seating action of the upwardly inclined ridges 40, 42.

The blade 37 may be released from razor 10 simply by applying a pinching force near the upper end of the razor in the region P, as earlier described. Thus, it will be appreciated that blades may be both introduced to and removed from razor 10 without directly touching the blade.

The present embodiments are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A barber-type razor for housing a replaceable blade comprising:

a body member having a handle and a blade-receiving base portion;

a clamp member hinged to the base portion by means of a hinge between and extending longitudinally of said base portion and said clamp member, said hinge being located between the top and bottom portions of said base portion and said clamp member, said base portion and said clamp member forming opposite halves of the razor;

bias means provided for urging the bottom portions of said razor halves relatively toward one another for retaining a blade therebetween below the hinge, the blade being released when the top portions of said razor halves are moved relatively toward one another;

said razor having a first region (G) along a top portion thereof for receiving manual gripping forces during normal use and a second region (P) forward of said first region for receiving manual blade-releasing pinch forces; and one of said razor halves extends upwardly beyond the other along said first gripping region (G) to receive any such gripping forces substantially exclusively of the other to prevent inadvertent release of a blade, said razor halves being structured along said second region to facilitate application of a manual blade-releasing pinch force to both halves in said second region (P).

2. The razor of claim 1 wherein said base portion extends above said clamp member in said razor first region and said razor halves are upwardly substantially co-extensive in said second region.

3. The razor of claim 2 wherein the top portion of said base portion additionally extends transversely over said clamp member in said razor first region.

4. The razor of claim 3 wherein the longitudinal extend of said razor first region is substantially greater than that of said razor second region.

5. The razor of claim 1 wherein said bias means is a leaf spring positioned between said razor halves above said hinge.

6. The razor of claim 5 wherein said hinge entirely consists of hinge tube means affixed to at least one of said razor halves and pivot pins means integral with at least the other of said razor halves for selectively removable insertion into said hinge tube means.

7. The razor of claim 6 wherein said hinge tube means comprises a plurality of hinge tubes and said pivot pin means comprises a corresponding plurality of pivot pins.

8. The razor of claim 7 wherein said hinge tube means are affixed to only one of said razor halves and said pivot pins are integral only with the other of said razor halves.

9. The razor of claim 8 wherein the inner surfaces of each of said razor halves include a respective semi-cylindrical slot longitudinally formed therein, said hinge tubes being affixed in and substantially coaxial with a said slot, and said pivot pins are permanently affixed in and extend from support tubes which are in turn affixed in and substantially coaxial with the other of said slots.

10. The razor of claim 9 wherein said support tubes are positioned forwardly of the respective hinge tubes which receive said pivot pins, and said pivot pins extend rearwardly from said support tubes for said removable insertion into said hinge tubes.

11. The razor of claim 6 wherein said means for urging the bottom portions of said razor halves toward one another to retain a blade comprises a leaf spring seated in a longitudinal slot above said hinge in the inner surface of one of said razor halves and disposed for compressive engagement with the other.

12. The razor of claim 11 wherein said longitudinal spring seat slot includes a bend near its forward end, said spring includes a similar bend near its forward end for placement in said seat bend to effectively secure said spring against longitudinal motion thereat and includes a knee intermediate its ends, and the other of said razor halves includes a longitudinally shortened notch therei. for receiving said spring knee in compression therein and thereby inhibiting relative longitudinal movement between said razor halves.

13. The razor of claim 5 wherein a blade-seating region exists below said hinge for receiving a blade introduced longitudinally thereinto from the front of the razor, said blade-seating region having at least an upper limit thereto and being open at the bottom to permit blade removal, said blade-seating region including an array of longitudinally spaced, upwardly extending, rearwardly inclined ridges on the inner surface of at least one of said razor halves for aiding the seating of a blade at said seating region upper limit as the blade is moved rearwardly into the seating region.

14. A barber-type razor for housing a replaceable blade comprising:

a body member having a handle and a blade-receiving base portion;

a clamp member hinged to the base portion by means of a hinge between and extending longitudinally of said base portion and said clamp member, said base portion and said clamp member forming opposite halves of the razor, said hinge being located between the top and bottom portions of said razor halves and entirely consisting of a plurality of hinge tubes affixed to at least one of said razor halves and a plurality pivot pins integral with at least the other of said razor halves for selectively removable insertion into said respective hinge tubes, a blade being retained between said razor halves below said hinge when the bottom portions thereof are urged relatively toward one another, a leaf spring seated in a longitudinal slot above said hinge in the inner surface of one of said razor halves and disposed for compressive engagement with the other to urge said bottom portions toward one another, said longitudinal spring seat slot includes a bend near its forward end, said spring includes a similar bend near its forward end for placement in said seat bend to effectively secure said spring against longitudinal motion thereat and includes a knee intermediate its ends, and the other of said razor halves includes a longitudinally shortened notch therein for receiving said spring knee in compression therein and thereby inhibiting relative longitudinal movement between said razor halves.

15. A barber-type razor for housing a replaceable blade comprising a body member having a handle and a blade-receiving base portion forwardly of the handle, a clamp member hinged to the base portion by means of a hinge between and extending longitudinally of said base portion and said clamp member, said base portion and said clamp member comprising opposite halves of the razor, said hinge being located between the top and bottom portions of said base portion and said clamp member, a blade-seating region existing below said hinge for receiving a blade introduced thereinto from the front of the razor, said seating region having at least an upper limit thereto and being open at the bottom to permit blade removal, bias means for yieldably urging the bottom portions of said razor halves relatively toward one another to retain a blade therebetween, said bias means yielding to permit relative rotation of said clamp member to allow said introduction of a blade and removal of a blade, and said blade-seating region including means for engaging and relatively upwardly moving a blade and aiding the seating thereof at said seating region upper limit as the blade is moved rearwardly into the seating region.

16. The razor of claim 15 wherein said blade-seating aiding means comprises an array of longitudinally spaced, upwardly extending, rearwardly inclined ridges on the inner surface of at least one of said razor halves.

17. The razor of claim 16 wherein said ridges are on the respective inner surfaces of both of said razor halves.

18. The razor of claim 17 wherein said ridges comprise planar surfaces parallel to said inner surfaces and displaced outward therefrom at least about 0.005 inch.

* * * * *